US008191732B2

(12) United States Patent
Ehlert et al.

(10) Patent No.: US 8,191,732 B2
(45) Date of Patent: Jun. 5, 2012

(54) ULTRASONIC WAVEGUIDE PUMP AND METHOD OF PUMPING LIQUID

(75) Inventors: Thomas David Ehlert, Neenah, WI (US); Patrick Sean McNichols, Hortonville, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 793 days.

(21) Appl. No.: 12/335,332

(22) Filed: Dec. 15, 2008

(65) Prior Publication Data

US 2009/0155091 A1 Jun. 18, 2009

Related U.S. Application Data

(63) Continuation-in-part of application No. 11/337,634, filed on Jan. 23, 2006, now Pat. No. 7,735,751.

(51) Int. Cl.
*F04B 17/00* (2006.01)

(52) U.S. Cl. ..... 222/1; 222/52; 222/196; 417/53; 417/322

(58) Field of Classification Search ..... 222/1, 52, 222/382, 464.1, 196; 417/53, 321
See application file for complete search history.

(56) References Cited

U.S. PATENT DOCUMENTS

| | | | |
|---|---|---|---|
| 2,584,053 | A | 1/1952 | Seavey et al. |
| 2,946,981 | A | 7/1960 | O'Neill |
| 3,246,881 | A | 4/1966 | Davidson et al. |
| 3,519,251 | A | 7/1970 | Hammitt et al. |
| 3,542,345 | A | 11/1970 | Kuris |
| 3,567,185 | A | 3/1971 | Ross et al. |
| 3,865,350 | A | 2/1975 | Burtis |
| 4,259,021 | A | 3/1981 | Goudy, Jr. |
| 4,266,879 | A | 5/1981 | McFall |
| 4,389,999 | A | 6/1983 | Jaqua |
| 4,469,974 | A | 9/1984 | Speranza |
| 4,511,254 | A | 4/1985 | North et al. |
| 4,535,741 | A | 8/1985 | Hertz |

(Continued)

FOREIGN PATENT DOCUMENTS

CN 657067 8/1986

(Continued)

OTHER PUBLICATIONS

International Search Report and Written Opinion regarding PCT/IB2008/052905, dated Mar. 27, 2009.

(Continued)

*Primary Examiner* — Kevin P Shaver
*Assistant Examiner* — Donnell Long
(74) *Attorney, Agent, or Firm* — Armstrong Teasdale LLP

(57) ABSTRACT

In a waveguide pump and method of pumping liquid, at least a portion of an elongate ultrasonic waveguide is immersed in a liquid reservoir. The waveguide has first and second ends, a nodal region located longitudinally therebetween, and an internal passage extending longitudinally within the waveguide from the first end to a location beyond the nodal region toward the second end of the waveguide. The waveguide also has an inlet at the first end in fluid communication with the internal passage and an outlet in fluid communication with the internal passage and spaced longitudinally from the inlet beyond the nodal region of the waveguide. The immersed portion of the waveguide extends from the inlet to a location that is one of generally longitudinally adjacent, at and beyond the nodal region of the waveguide. The waveguide is ultrasonically excited to cause the waveguide to vibrate at an ultrasonic frequency.

20 Claims, 7 Drawing Sheets

U.S. PATENT DOCUMENTS

| | | | | |
|---|---|---|---|---|
| 4,553,059 | A | 11/1985 | Seiko | |
| 4,750,706 | A | 6/1988 | Schlagmuller | |
| 4,764,021 | A | 8/1988 | Eppes | |
| 4,799,622 | A | 1/1989 | Ishikawa et al. | |
| 4,917,579 | A | 4/1990 | Torma | |
| 4,974,780 | A | 12/1990 | Nakamura et al. | |
| 4,978,067 | A | 12/1990 | Berger et al. | |
| 4,983,045 | A | 1/1991 | Taniguchi | |
| 5,026,167 | A | 6/1991 | Berliner, III | |
| 5,032,027 | A | 7/1991 | Berliner, III | |
| 5,128,193 | A | 7/1992 | Anapol et al. | |
| 5,169,067 | A | 12/1992 | Matsusaka et al. | |
| 5,192,197 | A * | 3/1993 | Culp | 417/322 |
| 5,248,087 | A | 9/1993 | Dressler | |
| 5,326,164 | A | 7/1994 | Logan | |
| 5,327,041 | A | 7/1994 | Culp | |
| 5,330,100 | A | 7/1994 | Malinowski | |
| 5,371,429 | A | 12/1994 | Manna | |
| 5,391,000 | A | 2/1995 | Taniguchi | |
| 5,484,104 | A | 1/1996 | Kukler | |
| 5,516,043 | A | 5/1996 | Manna et al. | |
| 5,532,539 | A | 7/1996 | Hielscher | |
| 5,803,106 | A | 9/1998 | Cohen et al. | |
| 5,803,270 | A | 9/1998 | Brodeur | |
| 5,810,255 | A | 9/1998 | Itoh et al. | |
| 5,868,153 | A | 2/1999 | Cohen et al. | |
| 5,938,075 | A * | 8/1999 | Murai et al. | 222/1 |
| 6,053,424 | A | 4/2000 | Gipson et al. | |
| 6,074,466 | A | 6/2000 | Iwasa | |
| 6,380,264 | B1 | 4/2002 | Jameson et al. | |
| 6,383,301 | B1 | 5/2002 | Bell et al. | |
| 6,450,417 | B1 | 9/2002 | Gipson et al. | |
| 6,488,670 | B1 | 12/2002 | Schild et al. | |
| 6,506,584 | B1 | 1/2003 | Chandler et al. | |
| 6,543,700 | B2 | 4/2003 | Jameson et al. | |
| 6,655,826 | B1 | 12/2003 | Leanos | |
| 6,659,365 | B2 | 12/2003 | Gipson et al. | |
| 6,676,003 | B2 | 1/2004 | Ehlert et al. | |
| 6,688,579 | B2 | 2/2004 | Grytz | |
| 6,732,720 | B2 | 5/2004 | Kelemencky | |
| 6,772,963 | B2 | 8/2004 | Neretti et al. | |
| 6,776,352 | B2 | 8/2004 | Jameson | |
| 6,827,332 | B2 | 12/2004 | Hanneke et al. | |
| 6,874,706 | B2 | 4/2005 | Hanneke et al. | |
| 6,880,770 | B2 | 4/2005 | Jameson et al. | |
| 6,935,770 | B2 | 8/2005 | Schueler | |
| 7,424,883 | B2 | 9/2008 | McNichols et al. | |
| 2002/0070298 | A1 | 6/2002 | Jameson et al. | |
| 2003/0066899 | A1 | 4/2003 | Gipson | |
| 2004/0022695 | A1 | 2/2004 | Simon et al. | |
| 2004/0042915 | A1 * | 3/2004 | Rife et al. | 417/321 |
| 2004/0112779 | A1 | 6/2004 | Arndt | |
| 2006/0120212 | A1 | 6/2006 | Taniguchi et al. | |
| 2006/0175352 | A1 * | 8/2006 | Emmendorfer et al. | 222/148 |
| 2007/0170275 | A1 | 7/2007 | Ehlert et al. | |
| 2007/0170276 | A1 | 7/2007 | McNichols et al. | |
| 2007/0170277 | A1 | 7/2007 | Ehlert et al. | |
| 2007/0170278 | A1 | 7/2007 | McNichols et al. | |
| 2008/0272204 | A1 | 11/2008 | McNichols et al. | |
| 2010/0044452 | A1 | 2/2010 | Ehlert et al. | |

FOREIGN PATENT DOCUMENTS

| | | | |
|---|---|---|---|
| CN | 1698094 | A | 11/2005 |
| DE | 9017338 | | 3/1991 |
| DE | 4203729 | | 8/1993 |
| DE | 19854013 | | 5/2000 |
| EP | 0036617 | A | 9/1981 |
| EP | 57466 | | 8/1982 |
| EP | 347891 | | 12/1989 |
| EP | 0361480 | | 4/1990 |
| EP | 648531 | | 4/1995 |
| FR | 2708487 | | 2/1995 |
| FR | 2751702 | A | 1/1998 |
| GB | 1344635 | | 1/1974 |
| JP | 57005545 | A | 1/1982 |
| JP | 62070656 | | 4/1987 |
| JP | 3094855 | | 4/1991 |
| JP | 03-222851 | | 10/1991 |
| JP | 03222851 | A | 10/1991 |
| JP | 200101797 | | 1/2001 |
| JP | 2003526302 | | 9/2003 |
| SU | 1812332 | | 4/1993 |
| WO | 9600318 | | 1/1996 |
| WO | 9723305 | | 7/1997 |
| WO | 0029178 | | 5/2000 |
| WO | 2007010166 | | 1/2007 |
| WO | 2007136427 | | 11/2007 |

OTHER PUBLICATIONS

Non-final Office action regarding U.S. Appl. No. 11/337,953, dated Apr. 13, 2010.
International Search Report and Written Opinion regarding PCT/IB2008/052906, dated Apr. 22, 2009.
Final Office Action regarding U.S. Appl. No. 11/780,901, dated Apr. 29, 2010.
International Search Report and Written Opinion regarding PCT/US2007/001060, dated May 20, 2009.
Non-final Office Action regarding U.S. Appl. No. 11/780,840, dated Oct. 28, 2009.
European Search Report regarding European Application No. 09169166.7, dated Oct. 28, 2009.
Non-final Office Action regarding U.S. Appl. No. 11/780,901, dated Nov. 2, 2009.
Office Action received in U.S. Appl. No. 11/337,953 mailed Dec. 23, 2010.
Final Office action regarding U.S. Appl. No. 11/337,953, dated Dec. 31, 2009.
Communication received in EP Application No. 08867024.5 dated Jan. 10, 2011.
Office Action received in CN Patent Application No. 200780008819.0 mailed Mar. 9, 2011.
International Search Report for PCT/US2007/001054, dated May 14, 2007, 3 pages.
International Search Report regarding PCT/IB2007/053622, dated Feb. 14, 2008.
International Search Report and Written Opinion regarding PCT/IB2007/053621, dated Feb. 14, 2008.
International Search Report and Written Opinion regarding PCT/IB2007/001056, dated Feb. 13, 2008.
Office action regarding U.S. Appl. No. 11/337,638, dated May 5, 2008.
Non-final office action regarding U.S. Appl. No. 11/337,638, dated Nov. 14, 2008.
Non-final office action regarding U.S. Appl. No. 11/337,634, dated Dec. 26, 2008.
Non-final office action regarding U.S. Appl. No. 11/337,953, dated Dec. 18, 2008.
U.S. Appl. No. 11/780,901, filed Jul. 20, 2007.
U.S. Appl. No. 11/780,840, filed Jul. 20, 2007.
U.S. Appl. No. 11/966,530, filed Dec. 28, 2007.
U.S. Appl. No. 11/780,860, filed Jul. 20, 2007.
International Search Report and Written Opinion for PCT/IB2008/052905 mailed Mar. 27, 2009.
Non-final Office Action regarding U.S. Appl. No. 11/337,638, dated May 19, 2009.
Non-final Office Action regarding U.S. Appl. No. 11/337,953, dated May 26, 2009.
International Search Report and Written Opinion regarding PCT/IB2009/055096, dated Jun. 16, 2010.
International Search Report and Written Opinion regarding PCT/IB2008/055397, dated Jun. 22, 2009.
Non-final Office Action regarding U.S. Appl. No. 11/337,634, dated Jun. 11, 2009.
Advisory Action received in U.S. Appl. No. 11/337,953 mailed Dec. 3, 2010.
Non-final Office action regarding U.S. Appl. No. 11/780,860, dated Nov. 2, 2009.

* cited by examiner

ULTRASONIC WAVEGUIDE PUMP AND METHOD OF PUMPING LIQUID

CROSS-REFERENCE TO RELATED APPLICATION

This application is a continuation-in-part of U.S. patent application Ser. No. 11/337,634, filed Jan. 23, 2006, the entirety of which is hereby incorporated by reference.

FIELD OF THE INVENTION

This invention relates generally to pumps for pumping liquid and more particularly to an ultrasonically driven pump which relies on ultrasonic energy to pump liquid.

BACKGROUND

Conventional mechanical pumps (e.g., positive displacement pumps or reciprocating-type pumps) pump liquid with various types of mechanical moving parts (e.g., screws, vanes, diaphragms, etc.) which forcefully interact with the liquid while pumping. Shear is thus applied to the liquid by the forceful interaction with the moving parts. The material properties (e.g., viscosity) of shear-sensitive liquids may be materially altered by such shear forces experienced using conventional mechanical pumps. For example, some shear-sensitive liquids (e.g., a solution of corn starch and water) exhibit shear thickening upon an increase in the rate of shear. Shear thickening is the accompanying increase of viscosity of the liquid in response to the application of force thereof. Alternatively, a number of shear-sensitive liquids (e.g., latex-based paint or blood) exhibit shear-thinning in response to the application of force, wherein their viscosity decreases in response to the increasing rate of shear. Additionally, pump components can be damaged when pumping liquids containing particulates interspersed therein.

There is a need, therefore, for a pump for pumping liquid which reduces the shear forces experienced by the liquid during pumping and is less susceptible to wear from liquids that contain particulates.

SUMMARY

In one embodiment, an ultrasonically driven pump for pumping liquid from a reservoir containing such liquid general comprises an elongate ultrasonic waveguide having longitudinally opposite first and second ends, a nodal region located longitudinally between said first and second ends of the waveguide, and an internal passage extending longitudinally within the waveguide along at least a portion of the waveguide from the first end to beyond the nodal region toward the second end of the waveguide. The waveguide has an inlet at the first end in fluid communication with the internal passage for receiving liquid from the reservoir into the waveguide. The waveguide also has an outlet in fluid communication with the internal passage and spaced longitudinally from the inlet at a location longitudinally beyond the nodal region of the waveguide relative to the inlet for exhausting liquid from the pump. The waveguide is configured for greater longitudinal displacement at the inlet than at the outlet of the waveguide in response to ultrasonic excitation of the waveguide. An excitation device is operable to ultrasonically excite the waveguide to vibrate at least longitudinally of the waveguide.

In another embodiment, an ultrasonically driven pump for pumping liquid from a reservoir generally comprises an elongate ultrasonic waveguide having longitudinally opposite first and second ends, a first longitudinal segment including the first end, a second longitudinal segment including the second end and being coaxially aligned with the first longitudinal segment, and an internal passage extending longitudinally within the waveguide along at least a portion of the waveguide from the first end through the first segment and into the second segment. The waveguide further has an inlet at the first end in fluid communication with the internal passage for taking liquid from the reservoir into the waveguide, and an outlet in the second segment in fluid communication with the internal passage for exhausting liquid from the pump. The first longitudinal segment is sized larger than the second longitudinal segment in at least one of a length, a thickness and an outer cross-sectional dimension of the waveguide. An excitation device is operable to ultrasonically excite the waveguide to vibrate at least longitudinally of the waveguide.

In one embodiment of a method of pumping a liquid, at least a portion of an elongate ultrasonic waveguide is immersed in a reservoir of liquid. The waveguide has longitudinally opposite first and second ends, a nodal region located longitudinally between the first and second ends of the waveguide, and an internal passage extending longitudinally within the waveguide along at least a portion of the waveguide from the first end to beyond the nodal region toward the second end of the waveguide. The waveguide also has an inlet at the first end in fluid communication with the internal passage and an outlet in fluid communication with the internal passage and spaced longitudinally from the inlet at a location longitudinally beyond the nodal region of the waveguide relative to the inlet. The immersed portion of the waveguide extends from the inlet at the first end of the waveguide to a location that is one of generally longitudinally adjacent, at and beyond the nodal region of the waveguide. The waveguide is ultrasonically excited to cause the waveguide to vibrate at an ultrasonic frequency.

BRIEF DESCRIPTION OF THE DRAWINGS

Corresponding reference characters indicate corresponding parts throughout the drawings.

DETAILED DESCRIPTION OF THE INVENTION

Figure 1:
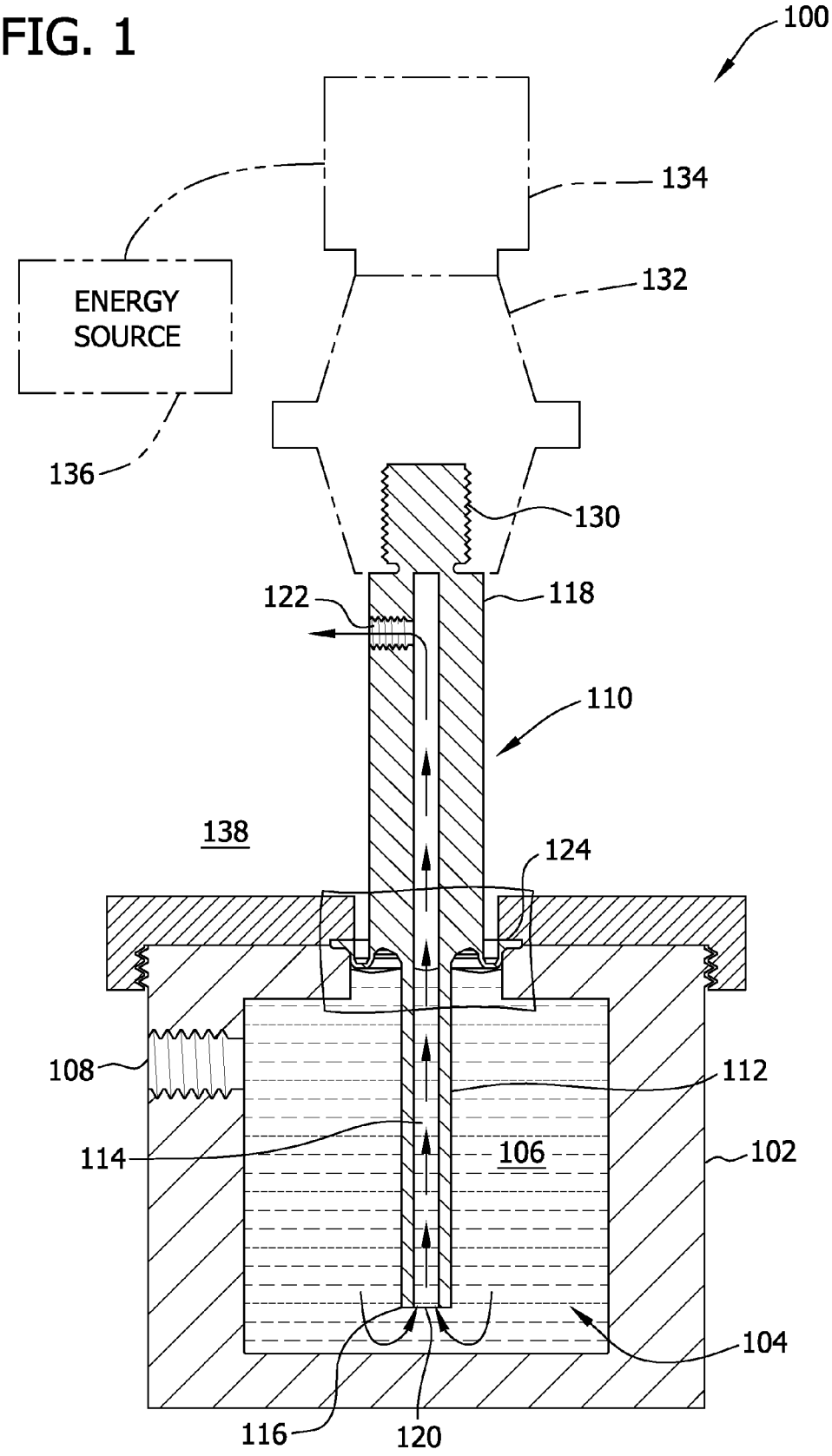
FIG. 1 is a schematic, longitudinal cross-section of one embodiment of an ultrasonically driven pump mounted to a reservoir housing.

With reference now to the drawings and in particular to FIG. 1, one embodiment of an ultrasonically driven pump is indicated generally at 100 and illustrated as being mounted to a reservoir housing 102 having an interior chamber 104 containing a liquid 106 to be pumped. The term liquid, as used herein, refers to an amorphous (noncrystalline) form matter intermediate between gases and solids, in which the molecules are much more highly concentrated than in gases, but much less concentrated than in solids. The liquid 106 may comprise a single component or may be comprised of multiple components. For example, characteristic of liquids is their ability to flow as a result of an applied force. Liquids that flow immediately upon application of force and for which the rate of flow is directly proportional to the force applied are generally referred to as Newtonian fluids. Other suitable liquids have abnormal flow response when force is applied and exhibit non-Newtonian flow properties.

For example, the ultrasonic waveguide pump 100 may be used to pump liquids 106 such as, without limitation, water, blood, molten bitumens, viscous paints, hot melt adhesives, thermoplastic materials that soften to a flowable form when exposed to hear and return to a relatively set or hardened condition upon cooling (e.g., crude rubber, wax, polyolefins and the like), syrups, heavy oils, inks, fuels, liquid medication, emulsions, slurries, suspension and combinations thereof.

The terms "upper" and "lower" are used herein in accordance with the vertical orientation of the pumps illustrated in the various drawings and are not intended to describe a necessary orientation of the pump in use. That is, it is understood that the pumps may be oriented other than in the vertical orientation illustrated in the drawings (e.g., horizontal, inverted from the illustrated orientation, or other suitable orientation) and remain within the scope of this invention. The terms axial and longitudinal refer directionally herein to the lengthwise direction of the pumps (e.g., the vertical direction in the illustrated embodiments). The terms transverse, lateral and radial refer herein to a direction normal to the axial (i.e., longitudinal) direction. The terms inner and outer are also used in reference to a direction transverse to the axial direction of the pumps, with the term inner referring to a direction toward the interior of the pump and the term outer referring to a direction toward exterior of the pump.

The illustrated reservoir housing 102 has an inlet 108 through which liquid 106 to be pumped enters the interior chamber 104 of the housing. Such an arrangement allows for continuous processing (e.g., pumping) of liquid 106 through the reservoir housing 102. It is understood, however, that the reservoir housing 102 and pump 100 may be used for batch-type processing instead of continuous processing without departing from the scope of this invention. For example, in another suitable embodiment the inlet 108 may be omitted and the reservoir 102 provided with a lid or closure that is removeable from the reservoir housing to permit liquid 106 to be loaded into the interior chamber 104 of the reservoir for batch processing.

The ultrasonic waveguide pump 100 is suitably formed separate from the reservoir housing and generally comprises an elongate ultrasonic waveguide 110. More suitably, the waveguide 110 is generally tubular, having a sidewall 112 defining an internal passage 114 extending longitudinally (e.g., axially) therein along at least a portion of the length of the waveguide. The illustrated waveguide 110 has longitudinally opposite ends (i.e., a first or lower end 116 and a second or upper end 118 in the illustrated orientation), with one of the ends (the lower end in FIG. 1) having an inlet opening 120 to define a pump inlet through which liquid enters the pump 100. The waveguide 110 also has an outlet opening 122 formed therein in longitudinally spaced relationship with the inlet opening 120 at the lower end 116 of the waveguide and in fluid communication with the internal passage 114 to define a pump outlet through which liquid 106 exits the pump 100.

In the illustrated embodiment of FIG. 1 the pump outlet 122 is disposed generally adjacent to the upper end 118 of the waveguide 110. It is understood, however, that the pump outlet 122 may be disposed anywhere along the length of the waveguide 110 as long as it is longitudinally spaced from the pump inlet 120. In the illustrated embodiment, the configuration of the waveguide 110 is such that a nodal plane (i.e., a plane transverse to the waveguide at which no longitudinal displacement occurs while transverse displacement is generally maximized) is not present. Rather, the waveguide 110 more suitably has a nodal region.

As used herein, the "nodal region" of the waveguide 110 refers to a longitudinal region or segment of the waveguide along which little (or no) longitudinal displacement occurs during ultrasonic vibration of the waveguide and transverse (e.g., radial in the illustrated embodiment) displacement is generally maximized. Transverse displacement of the waveguide 110 suitably comprises transverse expansion of the waveguide but may also include transverse movement (e.g., bending) of the waveguide. The nodal region of the illustrated waveguide 110 is generally dome-shaped such that at any given longitudinal location within the nodal region some longitudinal displacement may still be present while the primary displacement of the waveguide is transverse displacement. It is understood, however, that the waveguide 110 may be suitably configured to have a nodal plane (or nodal point as it is sometimes referred to) and that the nodal plane of such a waveguide is considered to be within the meaning of nodal region as defined herein. In a particularly suitable embodiment, the pump outlet 122 is located longitudinally adjacent, at, or more suitably beyond the nodal region of the waveguide in the direction of flow therethrough (e.g., in a direction from the lower end 116 toward the upper end 118 of the waveguide 110).

The upper end 118 of the illustrated waveguide 110 of FIG. 1 is closed to facilitate delivery of liquid from the internal passage 114 out through the pump outlet 122. Accordingly, it is understood that the waveguide 110 may be tubular along less than its entire length. For example, it may be solid for the entire segment length above the pump outlet 122. Alternatively, the waveguide 110 may be tubular along its entire length (i.e., the internal passage 114 may extend the entire length of the waveguide 110) so that the upper end of the waveguide is open. In some embodiments such as that illustrated in FIG. 5 and described in further detail later herein, such an open upper end of the waveguide 110 may suitably define the pump outlet 122 of the waveguide pump 100. The illustrated waveguide 110 has a generally annular (i.e., circular) cross-section. However, it is understood that the waveguide 110 may be shaped in cross-section other than annular without departing from the scope of this invention.

Figure 2:
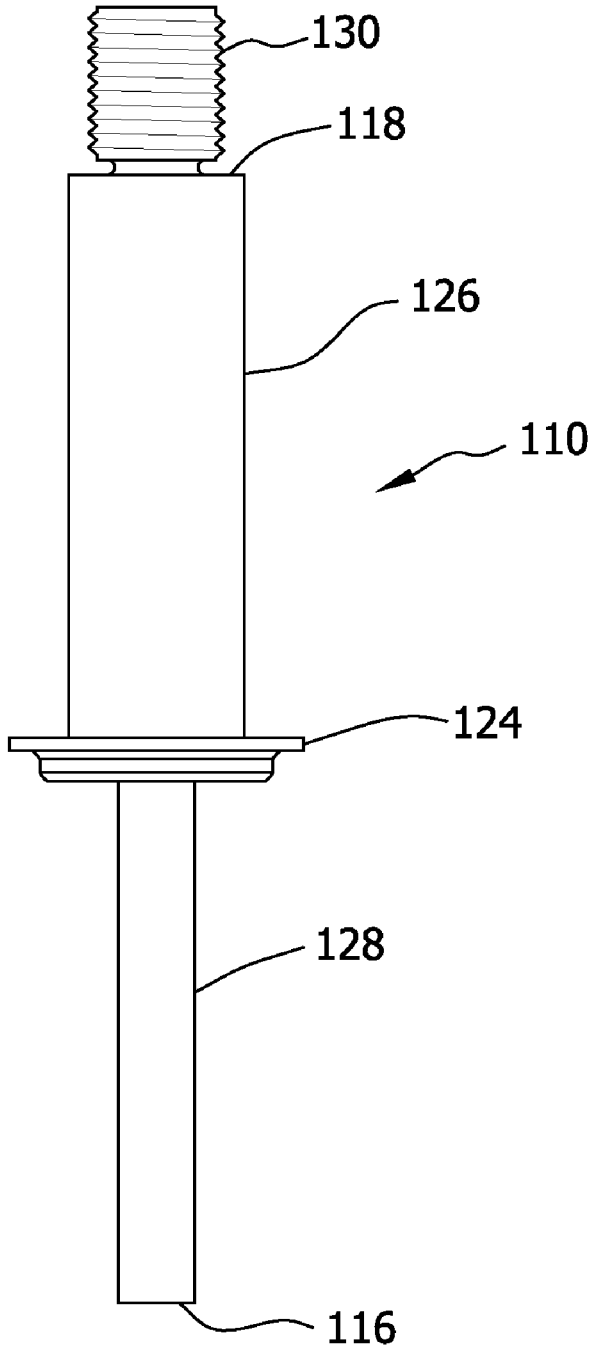
FIG. 2 is a side elevation of the ultrasonically driven pump of FIG. 1 separated from the reservoir housing.
Figure 3:
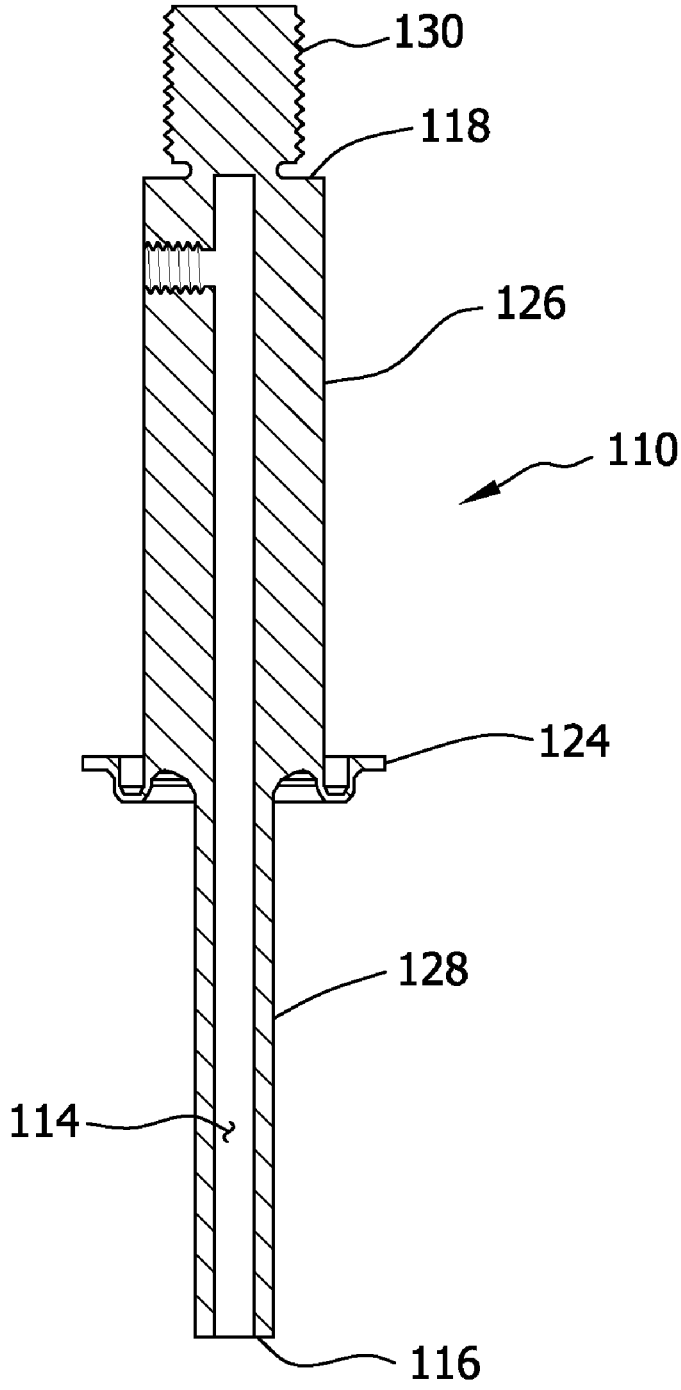
FIG. 3 is longitudinal cross-section of the ultrasonically driven pump of FIG. 1 separated from the reservoir housing.

With particular reference to FIGS. 2 and 3, the waveguide 110 according to one embodiment has a mounting member 124 for use in mounting the waveguide to the reservoir housing 102, an upper segment 126 extending longitudinally up from the mounting member 124 to the upper end 118 of the waveguide, a lower segment 128 extending down from the mounting member to the lower or inlet end 116 of the waveguide, and a threaded coupling 130 secured to the end of the upper segment in axial alignment therewith. In the illustrated embodiment, the waveguide 110 is constructed as a single piece—i.e., the upper and lower segments 126, 128, the mounting member 124 and the coupling 130 are formed integrally with each other. It is understood, however, that one or more of these elements may be formed separate from each other and secured thereto such as by welding, threaded fastening or other mechanical fastening. In general, the waveguide 110 may be constructed of a metal having suitable acoustical and mechanical properties. Examples of suitable metals for construction of the waveguide include, without limitation, aluminum, monel, titanium, and some alloy steels. It is also contemplated that all or part of the waveguide 110 may be coated with another metal.

As illustrated in FIG. 1, a suitable booster 132 is threadably connected to the coupling 130 at the upper end 118 of the waveguide 110, and a suitable transducer 134 (broadly, an excitation device) is connected to the booster 132 such that the waveguide, booster and transducer are axially aligned in a "stacked" configuration (the waveguide, transducer and booster together broadly defining an ultrasonic waveguide assembly). It is understood that in some embodiments the booster 132 may be omitted such that the transducer 134 is connected directly to the waveguide 110. A suitable energy source (broadly, a generating system 136) is in communication with the transducer 134 to energize the transducer. The generating system 136, transducer 134 and booster 132 are generally conventionally known components and can assume a variety of forms. In one suitable embodiment, for example, the generating system 136 may be operable to deliver high frequency electrical energy to the transducer 134. The transducer 134 converts the electrical energy to mechanical vibration. As such, the transducer 134 can be any available type of transducer such as a piezoelectric transducer, electromechanical transducer or other suitable transducer. The booster 132 is suitably configured to amplify the vibrational output from the transducer 134 and transfer the vibration to the waveguide 110 via the coupling.

The generating system 136, in accordance with one particularly suitable embodiment, is operable to energize the waveguide 110 to mechanically vibrate ultrasonically. The term "ultrasonic" as used herein refers to a frequency in the range of about 15 kHz to about 100 kHz. As an example, in one embodiment the generating system 136 may suitably deliver electrical energy to the transducer 134 (and hence to the waveguide 110) at an ultrasonic frequency in the range of about 15 kHz to about 100 kHz, more suitably in the range of about 15 kHz to about 60 kHz, and even more suitably in the range of about 20 kHz to about 40 kHz. Such generating systems are well known to those skilled in the art and need not be further described herein. In alternative embodiments, the transducer 134 (i.e., the excitation device) may comprise a magnetostrictive material responsive to a magnetic field generator (broadly, a generating system) that alters the magnetic field at ultrasonic frequencies (e.g., from on to off, from one magnitude to another, and/or a change in direction). Such an arrangement is also conventionally known.

With particular reference to FIG. 3, the cross-sectional dimension (e.g., inner diameter in the illustrated embodiment) of the internal passage 114 of the waveguide 110 is generally uniform along the length of the internal passage 114 and is suitably sized to accommodate a sufficient flow of liquid 106 therethrough. For example, in the illustrated embodiment, the internal passage 114 of the waveguide 110 has a cross-sectional dimension in the range of about 0.5 mm to about 6.5 mm and is more suitably about 1.0 mm to about 4.0 mm. As another example, the diameter of the internal passage 114 of the waveguide 110 of FIG. 3 is 2.3 mm. It is understood, however, that the cross-sectional dimension of the internal passage 114 of the waveguide 110 may be other than within the above range depending on the desired restriction/rate of the liquid flow through pump 100. It is also contemplated that the inner cross-sectional dimension of the internal passage 114 of the waveguide may be non-uniform along all or part of the length of the passage. For example, the cross-sectional dimension of the internal passage 114 may be smaller nearer the inlet end 116 and then widen as the passage extends upward therefrom to control the rate of liquid flow through the pump 100.

In one embodiment, the upper and lower segments 126, 128 of the waveguide 110 are suitably configured (e.g., in at least one of cross-sectional dimension, thickness and length in the illustrated embodiment) relative to each other such that the nodal plane, or nodal region of the waveguide is axially located generally at the mounting member 124. In more particularly suitable embodiments, the upper segment 126 of the waveguide is configured to be larger than the lower segment 128 (e.g., in at least one of cross-sectional dimension, thickness and length in the illustrated embodiment) so that axial displacement of the lower segment upon ultrasonic vibration thereof is greater than that of the upper segment. For example, in one embodiment a ratio of the cross-sectional dimension (e.g., the diameter of the outer surface in the illustrated embodiment) of the upper segment 126 of the waveguide 110 to the cross-sectional dimension of the lower segment of the waveguide is in the range of about 10 to about 1, and more suitably about 3 to about 1. As another example, the cross-sectional dimension (i.e., diameter) of the upper segment 126 of the waveguide of FIG. 3 is about 0.375 inches (9.525 mm) and the cross-sectional dimension (i.e., diameter) of the lower segment 128 is about 0.160 inches (4.064 mm).

In another embodiment, a thickness (i.e., the transverse distance from the inner diameter defining the internal passage 114 to the outer surface) of the upper segment 128 of the waveguide 110 is larger than that of the lower segment 126. For example in one embodiment a ratio of the thickness of the upper segment 126 of the waveguide 110 to the thickness of the lower segment of the waveguide is in the range of about 20 to about 1, and more suitably about 5 to about 1. As another example, the thickness of the upper segment 126 of the waveguide of FIG. 3 is about 3.75 mm and the thickness of the lower segment 128 is about 1 mm.

The overall length (from the top of the upper segment to the bottom of the lower segment) of the waveguide 110 may suitably be equal to about one-half of the resonating wavelength (otherwise commonly referred to as one-half wavelength) of the waveguide. In particular, the waveguide 110 is suitably configured to resonate at an ultrasonic frequency in the range of about 15 kHz to about 100 kHz, more suitably in the range of about 15 kHz to about 60 kHz, and even more suitably in the range of about 20 kHz to about 40 kHz. The one-half wavelength waveguide 110 operating at such frequencies has a respective overall length (corresponding to a one-half wavelength) in the range of about 128 mm to about 20 mm, more suitably in the range of about 128 mm to about 37.5 mm and even more suitably in the range of about 100 mm to about 50 mm. As a more particular example, the waveguide 110 illustrated in FIGS. 1-3 is configured for operation at a frequency of about 40 kHz and has an overall length of about 60 mm. It is understood, however, that the waveguide 110 may sized longer or shorter than as set forth above, and may be sized to have a length equal to any multiple of one-half wave length (e.g., full wavelength, 1.5 wavelength, etc.) without departing from the scope of this invention. In the illustrated embodiment the length of the upper segment 126 of the waveguide 110 is slightly greater than the length of the lower segment 128 of the waveguide. It is understood, however, that the relative lengths of the upper and lower segments 126, 128 may vary depending on the desired axial location of the nodal region of the waveguide 110.

Figure 4:
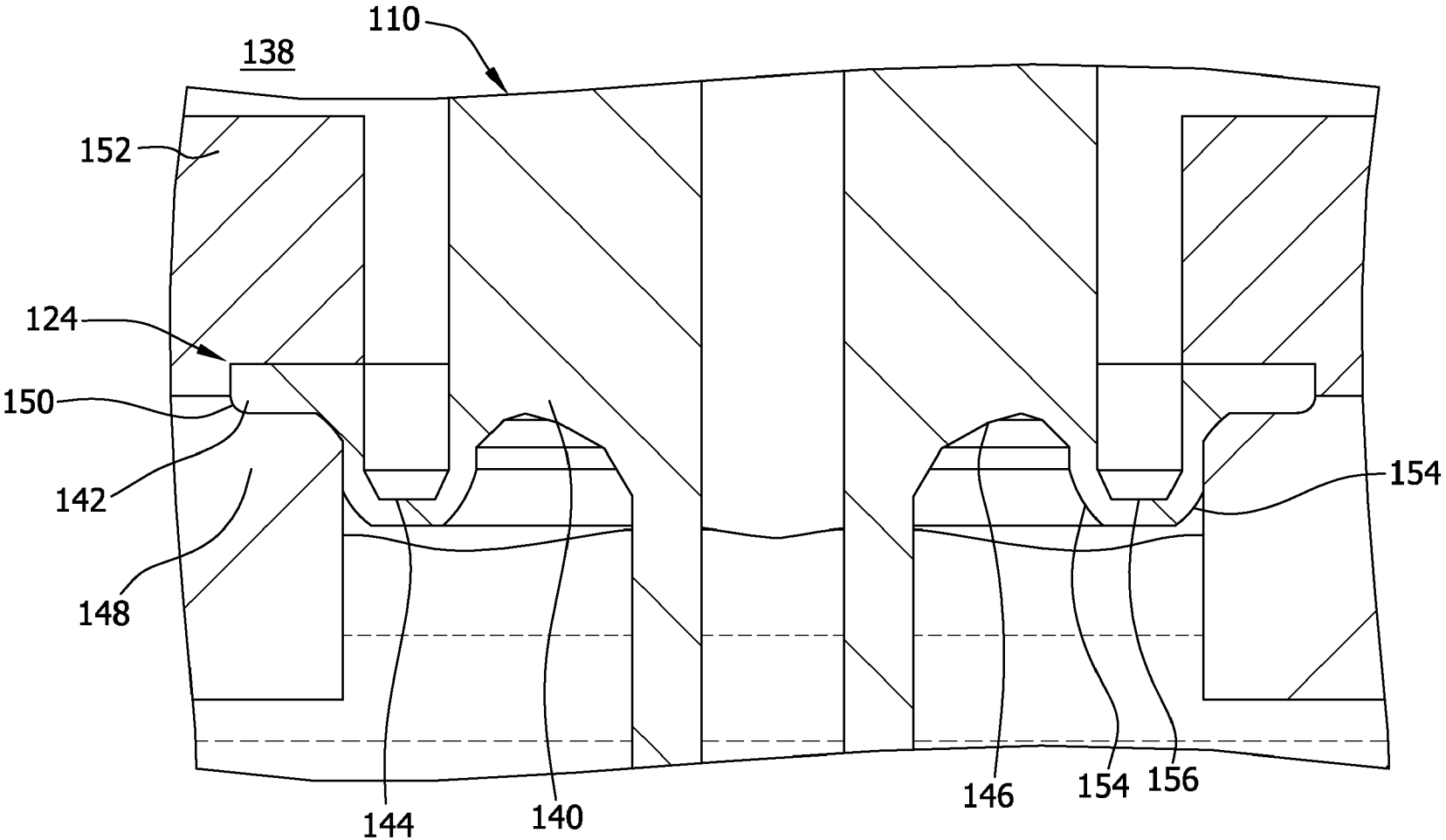
FIG. 4 is a fragmented cross-section of an enlarged portion of the ultrasonically driven pump and housing of FIG. 1.

With particular reference now to FIG. 4, the mounting member 124 is suitably connected to the waveguide 110 intermediate the upper and lower ends 116, 118 of the waveguide. More suitably, the mounting member 124 is connected to the waveguide 110 at or adjacent the nodal region of the waveguide. It is also contemplated that the mounting member 124 may be disposed longitudinally above or below the nodal region of the waveguide 110 without departing from the scope of the invention.

The mounting member 124 is suitably configured and arranged to vibrationally isolate the waveguide 110 from the reservoir housing 102. That is, the mounting member 124 inhibits the transfer of longitudinal and transverse (e.g., radial) mechanical vibration of the waveguide 110 to the housing 102 while maintaining the desired transverse position of the waveguide within an operating environment 138 and allowing longitudinal displacement of the waveguide within the housing. As one example, the mounting member 124 of the illustrated embodiment generally comprises an annular inner segment 140 extending transversely (e.g., radially in the illustrated embodiment) outward from the waveguide 110, an annular outer segment 142 extending transverse to the waveguide in transversely spaced relationship with the inner segment, and an annular interconnecting web 144 extending transversely between and interconnecting the inner and outer segments 140, 142. While the inner and outer segments 140, 142 and interconnecting web 144 extend continuously about the circumference of the waveguide 110, it is understood that one or more of these elements may be discontinuous about the waveguide such as in the manner of wheel spokes, without departing from the scope of this invention.

In the embodiment illustrated in FIG. 4, a lower surface 146 of the inner segment 140 is suitably contoured as it extends from adjacent the waveguide 110 to its connection with the interconnecting web 144, and more suitably has a blended radius contour. In particular, the contour of the lower surface 146 at the juncture of the web 144 and the inner segment 140 of the mounting member 124 is suitably a smaller radius (e.g., a sharper, less tapered or more corner-like) contour to facilitate distortion of the web during vibration of the waveguide 110. The contour of the lower surface 146 at the juncture of the inner segment 140 of the mounting member 124 and the waveguide 110 is suitably a relatively larger radius (e.g., a more tapered or smooth) contour to reduce stress in the inner segment of the mounting member upon distortion of the interconnecting web 144 during vibration of the waveguide.

The outer segment 142 of the mounting member 124 is configured to seat down against a shoulder 144 formed by the reservoir housing 102. As seen best in FIG. 4, the internal cross-sectional dimension (e.g., internal diameter) of the reservoir housing 102 is stepped inward longitudinally below the mounting member 124, so that that housing is longitudinally spaced from the contoured lower surface 146 of the inner segment 140 and interconnecting web 144 of the mounting member to allow for displacement of the mounting member during ultrasonic vibration of the waveguide 110. The mounting member 124 is suitably sized in transverse cross-section so that at least an outer edge margin 150 of the outer segment 142 is disposed longitudinally along the shoulder 148 of the reservoir housing 102. The outer segment 142 is suitably held in place (and thus the mounting member and hence the waveguide 110 is mounted on the housing 102) by a closure 152 that threadably fastens to the top of the reservoir housing.

The interconnecting web 144 is constructed to be relatively thinner than the inner and outer segments 140, 142 of the mounting member 124 to facilitate flexing and/or bending of the web in response to ultrasonic vibration of the waveguide 110. As an example, in one embodiment the thickness of the interconnecting web 144 of the mounting member 124 may be in the range of about 0.1 mm to about 1 mm, and more suitably about 0.4 mm. The interconnecting web 144 of the mounting member 124 suitably comprises at least one axial component 154 and at least one transverse (e.g., radial in the illustrated embodiment) component 156. In the illustrated embodiment, the interconnecting web 144 has a pair of transversely spaced axial components 154 connected by the transverse component 156 such that the web is generally U-shaped in cross-section.

It is understood, however, that other configurations that have at least one axial component 154 and at least one transverse component 156 are suitable, such as L-shaped, H-shaped, I-shaped, inverted U-shaped, inverted L-shaped, and the like, without departing from the scope of this invention. Additional examples of suitable interconnecting web 144 configurations are illustrated and described in U.S. Pat. No. 6,676,003, the disclosure of which is incorporated herein by reference to the extent it is consistent herewith.

The axial components 154 of the web 144 depend from the respective inner and outer segments 140, 142 of the mounting member and are generally cantilevered to the transverse component 156. Accordingly, the axial component 154 is capable of dynamically bending and/or flexing relative to the outer segment 142 of the mounting member 124 in response to transverse vibratory displacement of the inner segment 140 of the mounting member to thereby isolate the housing 102 and closure 152 from transverse displacement of the waveguide. The transverse component 156 of the web 144 is cantilevered to the axial components 154 such that the transverse component is capable of dynamically bending and flexing relative to the axial components (and hence relative to the outer segment 142 of the mounting member) in response to axial vibratory displacement of the inner segment 140 to thereby isolate the housing 102 from axial displacement of the waveguide 110.

In the illustrated embodiment, the waveguide 110 expands radially as well as displaces slightly axially at the nodal region (e.g., where the mounting member 124 is connected to the waveguide) upon ultrasonic excitation of the waveguide. In response, the U-shaped interconnecting member 144 (e.g., the axial and transverse components 154, 156 thereof) generally bends and flexes, and more particularly rolls relative to the fixed outer segment 142 of the mounting member 124, e.g., similar to the manner in which a toilet plunger head rolls upon axial displacement of the plunger handle. Accordingly, the interconnecting web 124 isolates the housing 102 from ultrasonic vibration of the waveguide 110, and in the illustrated embodiment it more particularly isolates the outer segment 142 of the mounting member from vibratory displacement of the inner segment 140 thereof. Such a mounting member 124 configuration also provides sufficient bandwidth to compensate for nodal region shifts that can occur during ordinary operation. In particular, the mounting member 124 can compensate for changes in the real time location of the nodal region that arise during the actual transfer of ultrasonic energy through the waveguide 110. Such changes or shifts can occur, for example, due to changes in temperature and/or other environmental conditions within the operating environment.

While in the illustrated embodiment the inner and outer segments 140, 142 of the mounting member 124 are disposed generally at the same longitudinal location relative to the waveguide, it is understood that the inner and outer segments may be longitudinally offset from each other without departing from the scope of this invention. It is also contemplated that the interconnecting web 144 may comprise only one or more axial components 154 (e.g., the transverse component 156 may be omitted) and remain within the scope of this invention. For example, where the waveguide 110 has a nodal plane and the mounting member 124 is located on the nodal plane, the mounting member need only be configured to isolate the transverse displacement of the waveguide. In an alternative embodiment (not shown), it is contemplated that the mounting member may be disposed at or adjacent an anti-nodal region of the waveguide 110, such as at or adjacent the upper end 118 of the waveguide (in which instance substantially the entire length of the waveguide would be disposed within the interior chamber of the reservoir housing. In such an embodiment, the interconnecting web 144 may comprise only one or more transverse components 156 to isolate axial displacement of the waveguide (i.e., little or no transverse displacement occurs at the anti-nodal region).

In one particularly suitable embodiment the mounting member 124 is of single piece construction. Even more suitably the mounting member 124 may be formed integrally with the waveguide 110 as illustrated in FIGS. 1-4. However, it is understood that the mounting member 124 may be constructed separate from the waveguide 110 and remain within the scope of this invention. It is also understood that one or more components of the mounting member 124 may be separately constructed and suitably connected or otherwise assembled together.

In one suitable embodiment the mounting member 124 is further constructed to be generally rigid (e.g., resistant to static displacement under load) so as to hold the waveguide 110 in proper alignment with reservoir housing 102. For example, the rigid mounting member 124 in one embodiment may be constructed of a non-elastomeric material, more suitably metal, and even more suitably the same metal from which the waveguide is constructed. The term rigid is not, however, intended to mean that the mounting member is incapable of dynamic flexing and/or bending in response to ultrasonic vibration of the waveguide 110. In other embodiments, the rigid mounting member may be constructed of an elastomeric material that is sufficiently resistant to static displacement under load but is otherwise capable of dynamic flexing and/or bending in response to ultrasonic vibration of the waveguide. While the mounting member 124 illustrated in FIGS. 1-4 is constructed of a metal, and more suitably constructed of the same material as the waveguide 110, it is contemplated that the mounting member may be constructed of other suitable generally rigid materials without departing from the scope of this invention.

With reference back to FIG. 1, the waveguide 110 is mounted to the reservoir housing 102 at the mounting member 124 such that prior to initial operation of the pump 100, liquid 106 in the interior chamber 104 of the reservoir housing fills the portion of the internal passage 114 of the waveguide within substantially the entire lower segment 128 of the waveguide. More suitably, the waveguide 110 is sufficiently immersed in the liquid 106 to be pumped such that the level of liquid within the internal passage 114 of the waveguide prior to initial operation of the pump 100 is substantially adjacent, and more suitably at or above the nodal region of the waveguide. It has been found that such an arrangement facilitates pumping of the liquid 106 through the internal passage 114 to the outlet port 122 upon ultrasonically energizing the waveguide 110. Thus, it will be understood that the waveguide 110 may be mounted to the reservoir housing 102 with the entire lower segment 128 and at least a portion of the upper segment 126 of the waveguide immersed in the liquid 106 within the interior chamber 104 of the reservoir 102, and in some embodiments the entire waveguide length below the booster 132 may be immersed in the liquid within the interior chamber of the reservoir.

In operation of the pump 100, liquid to be pumped is disposed in the interior chamber 104 of the reservoir housing 102, such as by being delivered into the chamber via the inlet opening in the housing. The waveguide 110, and more suitably the lower segment 126 thereof below the mounting member (e.g., below the nodal region in the illustrated embodiment) is immersed in the liquid in the housing 102 such that liquid enters the internal passage 114 of the waveguide via inlet 108. With the pump not yet ultrasonically energized, the liquid level within the internal passage 114 is suitably adjacent or at (and in other embodiments it may be longitudinally beyond, i.e., above) the nodal region of the waveguide. The energy source 136 is operated to send ultrasonic frequency electrical energy to the transducer 134 (i.e., the excitation device). The transducer converts the electrical energy into ultrasonic vibration (i.e., axial displacement), which ultrasonically drives vibration of the booster and hence the waveguide 110.

Upon ultrasonic excitation, the waveguide 110 experiences axial displacement (e.g., via lengthening and shortening of the waveguide) at its upper and lower ends 118, 116, and a blend of axial and transverse displacement (e.g., transverse expansion and contraction of the waveguide and hence of the internal passage 114) along the length between the upper and lower ends—with the transverse displacement being greatest at the nodal region—at the input ultrasonic frequency. Due to the relative configuration differences between the upper and lower segments 126, 128 of the waveguide 110, the axial displacement of the lower segment and more suitably at the inlet 108 of the waveguide is substantially greater than that of the upper segment and more suitably at the outlet 122 in response to the ultrasonic excitation. This differential facilitates movement of the liquid within the internal passage 114 of the waveguide 110 in a direction from the inlet 108 through the lower segment 128 past the nodal region and through the upper segment 126 to the outlet 122. The transverse expansion and contraction of the waveguide 110 at its nodal region further facilitates movement of the liquid through the internal passage 114 of the waveguide.

Figure 5:
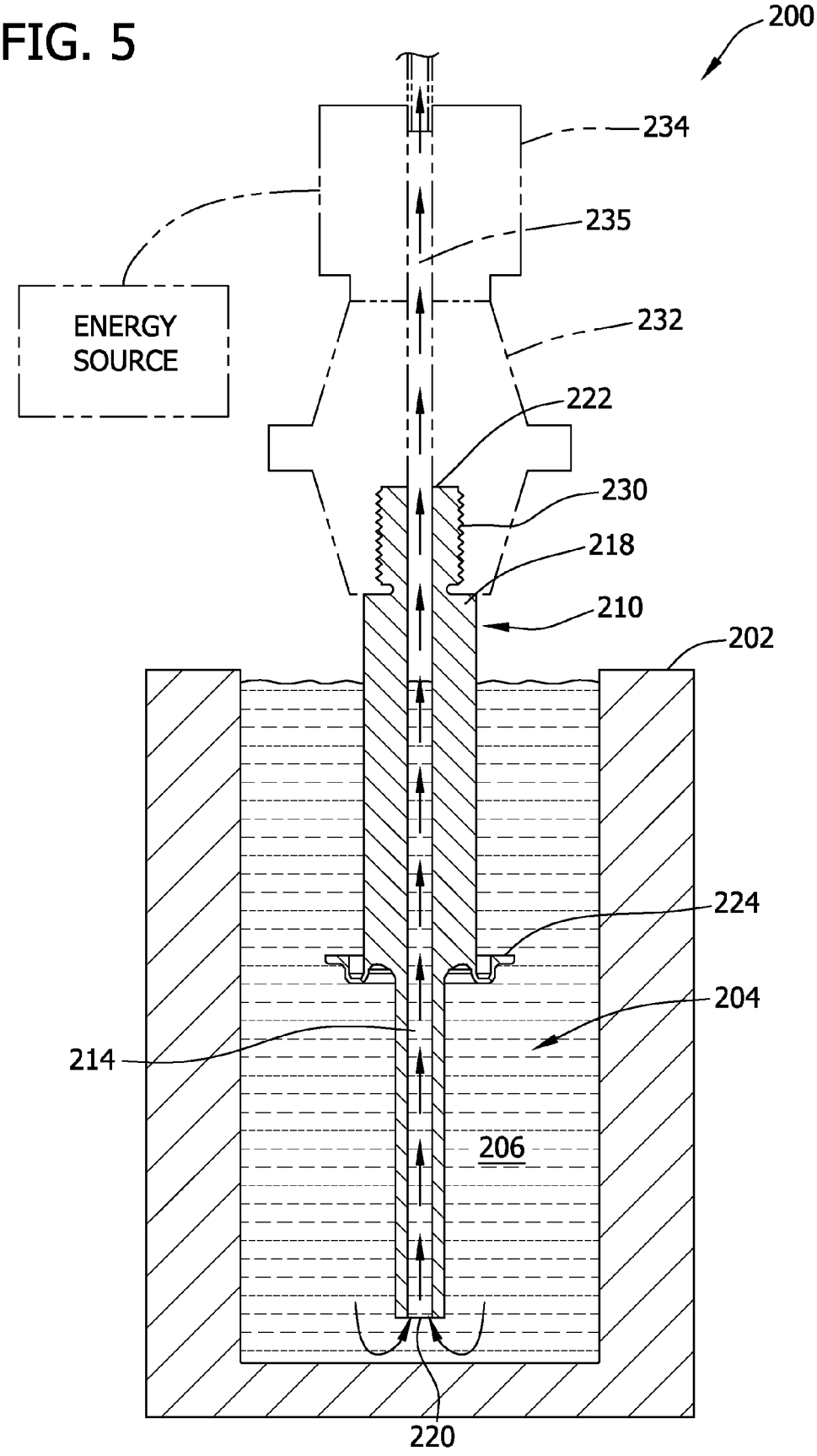
FIG. 5 is a schematic, longitudinal cross-section of a second embodiment of an ultrasonically driven pump separated from a reservoir housing and immersed in liquid within the housing.

FIG. 5 illustrates a second embodiment of an ultrasonically driven pump, indicated generally at 200, for use in pumping liquid 206 from an interior chamber 204 of a reservoir housing 202 with the pump being free from mounting to or other connection with the reservoir housing. The pump 200 of this embodiment comprises a waveguide 210 that is of substantially the same construction as the waveguide 110 of FIGS. 1-4 with the exception that the internal passage 214 of the waveguide 210 extends the entire length of the waveguide (i.e., the outlet port 222 of the pump is defined by open upper end 218 of the waveguide—e.g., the open end of the upper segment of the waveguide). The coupling 230, booster 232 and transducer 234 are suitably configured with a corresponding internal passage 235 aligned coaxially with the internal passage 214 of the waveguide 210 to provide a continuous passage through which liquid 206 is pumped from the pump inlet 220 to a suitable conduit 235 connected to the transducer 234 for carrying liquid away from the pump 200. Alternatively, a suitable outlet port (not shown) may be provided in either the booster 232 or the transducer 234 (similar to the outlet port 122 in the waveguide 110 of FIGS. 1-3) to exhaust liquid 206 from the pump 200.

The waveguide 210, booster 232 and transducer 234 are suitably connected together and are sufficiently supported relative to the reservoir housing 202 by a stand or other support structure (not shown). The support structure may be adjustable to permit adjustment of the immersion depth of the waveguide 210 in the liquid 206 within the internal chamber 204 of the reservoir 202. In this embodiment, the reservoir 202 is open at its top, although it is contemplated that a closure (not shown) having a central opening to accommodate the waveguide 210 therethrough may cover the reservoir housing without departing from the scope of this invention. Because the waveguide 210 is not mounted on the reservoir housing 202, it is contemplated that the mounting member 224 may be omitted from the waveguide of this embodiment without departing from the scope of this invention.

Figure 6:
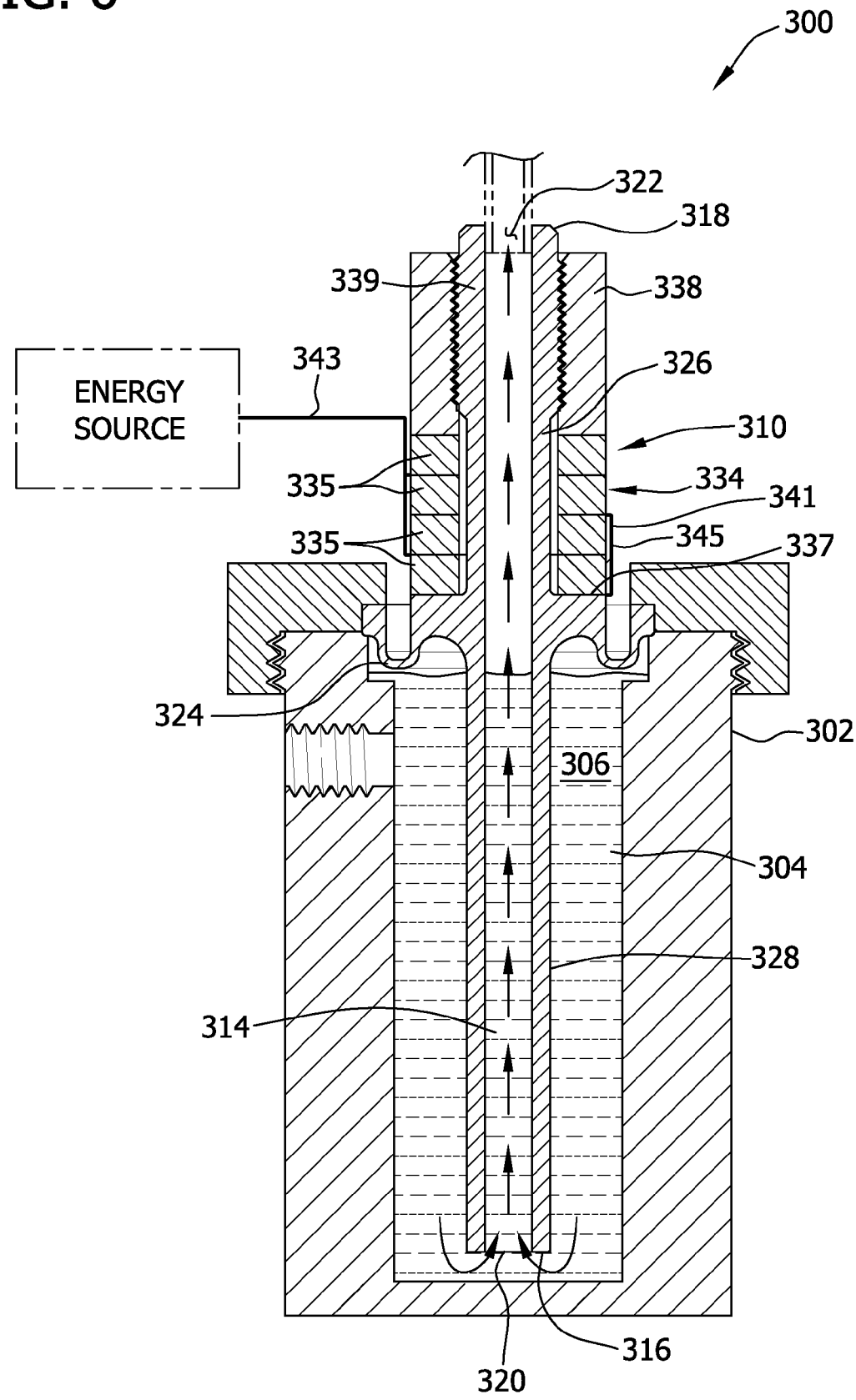
FIG. 6 is schematic, longitudinal cross-section of a third embodiment of an ultrasonically driven pump with the pump mounted to a reservoir housing.
Figure 7:
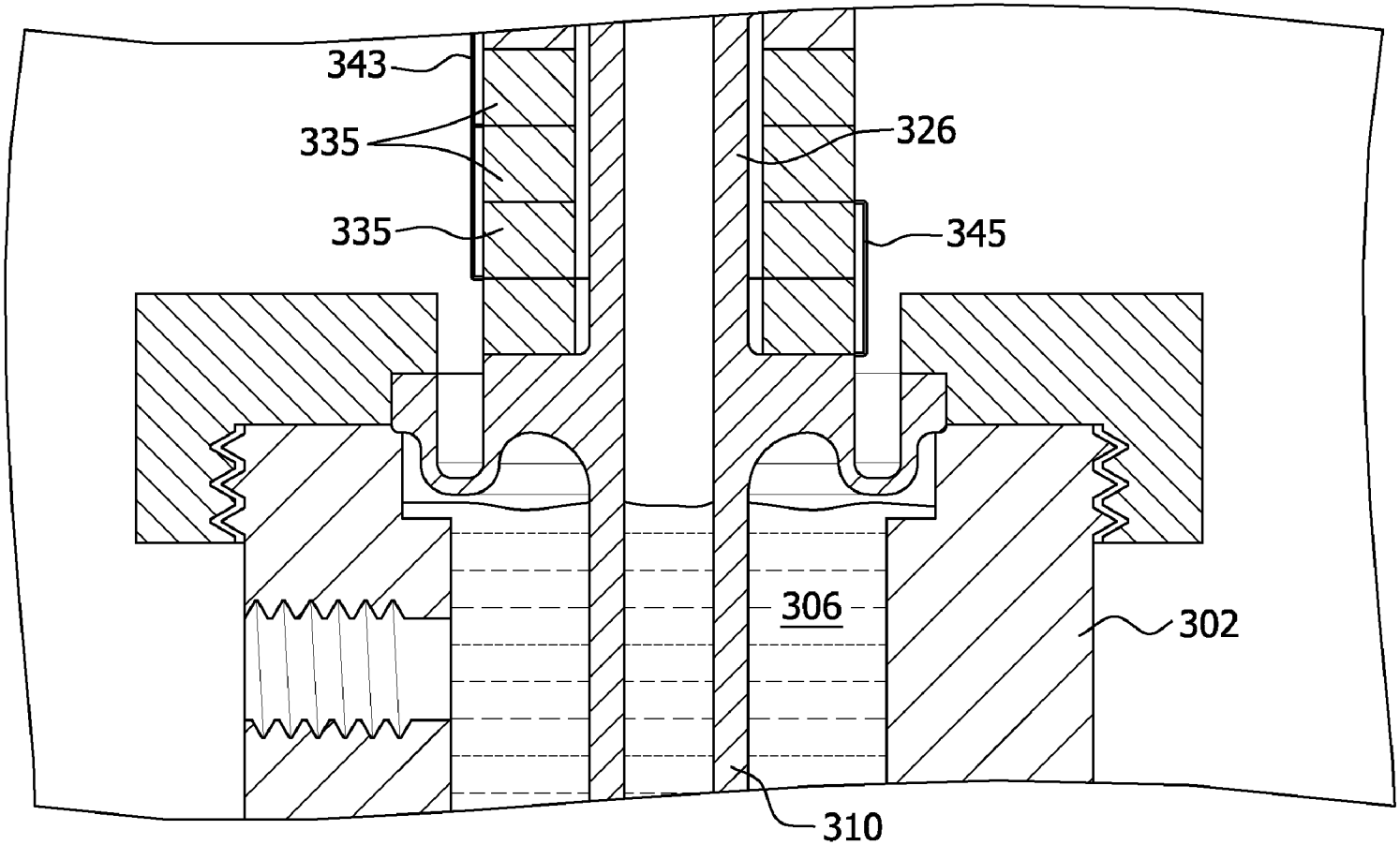
FIG. 7 is a fragmented cross-section of an enlarged portion of the ultrasonically driven pump and reservoir housing of FIG. 6.

A third embodiment of an ultrasonically driven pump is illustrated in FIGS. 6 and 7 and is indicated generally at 300 for pumping liquid 306 from an internal chamber 304 of a reservoir housing 302 that is substantially similar to the housing 102 of FIG. 1. The pump 300 comprises a tubular waveguide 310 having an internal passage 314 extending the entire length of the waveguide from a lower or inlet end 316 (broadly defining the pump inlet 320) of the waveguide to an outlet port 322 defined by the open upper or outlet end 318 (broadly defining the pump outlet) of the waveguide. The waveguide 310 also has a lower segment 328 and mounting member 324 constructed substantially similar to the lower segment 128 and mounting member 124 of the embodiment of FIG. 1.

The upper segment of the waveguide of this embodiment is narrower than that of the embodiment of FIG. 1 to accommodate a transducer (broadly, an excitation device) surrounding the upper segment. In particular, the excitation device comprises a piezoelectric device, and more suitably a plurality of stacked piezoelectric rings 335 (e.g., at least two and in the illustrated embodiment four) surrounding the upper segment 326 of the waveguide 310 and seated on a shoulder 337 formed by the mounting member 324. An annular collar 338 surrounds the upper segment 326 of the waveguide 310 above the piezoelectric rings 335 and bears down against the uppermost ring. Suitably, the collar 338 is constructed of a high density material. For example, one suitable material from which the collar 338 may be constructed is tungsten. It is understood, however, that the collar 338 may be constructed of other suitable materials and remain within the scope of this invention. An enlarged portion 339 adjacent the upper end 318 of the waveguide 310 has an increased outer cross-sectional dimension (e.g., an increased outer diameter in the illustrated embodiment) and is threaded along this segment. The collar 338 is internally threaded to threadably fasten the collar on the waveguide 310. The collar 338 is suitably tightened down against the stack of piezoelectric rings 335 to compress the rings between the collar and the shoulder 337 of the mounting member 324.

The waveguide 310 and excitation device 334 of the illustrated embodiment together broadly define a waveguide assembly, indicated generally at 341, for ultrasonically pumping a liquid 101. As an example, the illustrated waveguide assembly 341 is particularly constructed to act as both an ultrasonic horn and a transducer to ultrasonically vibrate the ultrasonic horn. In particular, the lower segment 328 of the waveguide 310 as illustrated in FIG. 6 generally acts in the manner of an ultrasonic horn while the upper segment 326 of the waveguide, and more suitably the portion of the upper segment that extends generally from the mounting member 324 to the location at which the collar 338 fastens to the upper segment of the waveguide together with the excitation device 334 (e.g., the piezoelectric rings 335) acts in the manner of a transducer.

Upon delivering electrical current (e.g., alternating current delivered at an ultrasonic frequency) to the piezoelectric rings 335 of the illustrated embodiment the piezoelectric rings expand and contract (particularly in the longitudinal direction of the pump 300) at the ultrasonic frequency at which current is delivered to the rings. Because the rings 335 are compressed between the collar 338 (which is fastened to the upper segment 326 of the waveguide 310) and the mounting member 324, expansion and contraction of the rings causes the upper segment of the waveguide to elongate and contract ultrasonically (e.g., generally at the frequency that the piezoelectric rings expand and contract), such as in the manner of a transducer. Elongation and contraction of the upper segment 326 of the waveguide 310 in this manner excites the resonant frequency of the waveguide, and in particular along the lower segment 328 of the waveguide, resulting in ultrasonic vibration of the waveguide along the lower segment, e.g., in the manner of an ultrasonic horn. As a result of this arrangement, the axial displacement of the lower segment 328 of the waveguide assembly 341 of this embodiment is substantially greater than that of the upper segment 326, thereby facilitating the flow of liquid 306 within the internal passage 314 from the lower segment 326 toward the upper segment for exhaustion through the outlet port 322.

It is contemplated that a portion of the waveguide 310 (e.g., a portion of the upper segment 326 of the waveguide) may alternatively be constructed of a magnetostrictive material that is responsive to magnetic fields changing at ultrasonic frequencies. In such an embodiment (not shown) the excitation device may comprise a magnetic field generator operable in response to receiving electrical current to apply a magnetic field to the magnetostrictive material wherein the magnetic field changes at ultrasonic frequencies (e.g., from on to off, from one magnitude to another, and/or a change in direction).

For example a suitable generator may comprise an electrical coil connected to the energy source (broadly, the generating system) which delivers current to the coil at ultrasonic frequencies. The magnetostrictive portion of the waveguide and the magnetic field generator of such an embodiment thus together act as a transducer while the lower segment 328 of the waveguide 310 again acts as an ultrasonic horn. One example of a suitable magnetostrictive material and magnetic field generator is disclosed in U.S. Pat. No. 6,543,700, the disclosure of which is incorporated herein by reference to the extent it is consistent herewith.

By placing the piezoelectric rings 335 and collar 338 about the upper segment 326 of the waveguide 310, the entire waveguide assembly 341 need be no longer than the waveguide itself (e.g., as opposed to the length of an assembly as in the embodiment of FIGS. 1-4 in which a transducer and ultrasonic horn are arranged in a "stacked" arrangement). As one example, the overall waveguide assembly 341 may suitably have a length equal to about one-half of the resonating wavelength (otherwise commonly referred to as one-half wavelength) of the waveguide. In particular, the waveguide assembly 341 is suitably configured to resonate at an ultrasonic frequency in the range of about 15 kHz to about 100 kHz, more suitably in the range of about 15 kHz to about 60 kHz, and even more suitably in the range of about 20 kHz to about 40 kHz. The one-half wavelength waveguide assembly 341 operating at such frequencies has a respective overall length (corresponding to a one-half wavelength) in the range of about 20 mm to about 128 mm, more suitably in the range of about 37.5 mm to about 128 mm and even more suitably in the range of about 50 mm to about 100 mm. As a more particular example, the waveguide assembly 341 illustrated in FIG. 6 is configured for operation at a frequency of about 40 kHz and has an overall length of about 50 mm.

Electrical wiring 343 is in electrical communication with an electrode (not shown) disposed between the uppermost piezoelectric ring 335 and the next lower piezoelectric ring. A separate wire (not shown) electrically connects the electrode to another electrode (not shown) disposed between the lowermost piezoelectric ring 335 and the ring just above it. The mounting member 324 and/or the waveguide 310 provide the ground for the current delivered to the piezoelectric rings 335. In particular, a ground wire 345 is connected to the mounting member 324 and extends up to between the middle two piezoelectric rings into contact with an electrode (not shown) disposed therebetween. Optionally, a second ground wire (not shown) may extend from between the middle two piezoelectric rings 335 into contact with another electrode (not shown) between the uppermost piezoelectric ring and the collar.

Upon initiating operation of the pump 300, the control system directs the high frequency electrical current generator to deliver current to the excitation device 334, i.e., the piezoelectric rings 335, via suitable wiring. As described previously, the piezoelectric rings 335 are caused to expand and contract (particularly in the longitudinal direction of the waveguide 310) generally at the ultrasonic frequency at which current is delivered to the excitation device 334.

Expansion and contraction of the rings 335 causes the upper segment 326 of the waveguide 310 to elongate and contract ultrasonically (e.g., generally at the same frequency that the piezoelectric rings expand and contract). Elongation and contraction of the upper segment 326 of the waveguide 310 in this manner excites the waveguide (e.g., suitably at the resonant frequency of the waveguide), and in particular along the lower segment 328 of the waveguide, resulting in ultrasonic vibration of the waveguide along the lower segment 328.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products without departing from the scope of the invention, it is intended that all matter contained in the above description and shown in the accompanying drawings shall be interpreted as illustrative and not in a limiting sense.

What is claimed is:

1. An ultrasonically driven pump for pumping liquid from a reservoir containing said liquid, said pump comprising:

an elongate ultrasonic waveguide having longitudinally opposite first and second ends, a nodal region located longitudinally between said first and second ends of the waveguide, and an internal passage extending longitudinally within the waveguide along at least a portion of the waveguide from said first end to beyond the nodal region toward said second end of the waveguide, the waveguide having an inlet at said first end in fluid communication with said internal passage for receiving liquid from the reservoir into the waveguide, said waveguide having an outlet in fluid communication with the internal passage and spaced longitudinally from the inlet at a location longitudinally beyond the nodal region of the waveguide relative to said inlet for exhausting liquid from the pump; said waveguide being configured for greater longitudinal displacement at said inlet than at said outlet of the waveguide in response to ultrasonic excitation of the waveguide; and an excitation device operable to ultrasonically excite said waveguide to vibrate at least longitudinally of the waveguide.

2. The ultrasonically driven pump of claim 1 wherein the internal passage extends longitudinally the entire length of the waveguide from said first end to said second end, the outlet being disposed at said second end.

3. The ultrasonically driven pump of claim 1 wherein the waveguide has a first longitudinal segment extending from the first longitudinal end toward the nodal region and a second longitudinal segment extending from the second longitudinal end toward the nodal region in coaxial alignment with the first longitudinal segment, the first longitudinal segment being sized larger than the second longitudinal segment in at least one of a length, a thickness and an outer cross-sectional dimension of the waveguide.

4. The ultrasonically driven pump of claim 3 wherein the internal passage has a cross-sectional dimension, said cross-sectional dimension of the internal passage being substantially constant along the entire length of the internal passage.

5. The ultrasonically driven pump of claim 1 wherein the excitation device and the waveguide together define an ultrasonic waveguide assembly, said assembly having a length of about one-half wavelength.

6. The ultrasonically driven pump of claim 2 wherein the excitation device is connected to the waveguide in a stacked configuration, said excitation device having an internal passage in fluid communication with the waveguide outlet for receiving liquid exhausted from the waveguide.

7. The ultrasonically driven pump of claim 1 further comprising a mounting member connected to the waveguide, said mounting member being configured for interconnecting the waveguide with the reservoir housing and to substantially vibrationally isolate the housing from the waveguide.

8. The ultrasonically driven pump of claim 7 wherein the mounting member is connected to the waveguide generally at the nodal region of the waveguide.

9. An ultrasonically driven pump for pumping liquid from a reservoir containing said liquid, said pump comprising:

an elongate ultrasonic waveguide having longitudinally opposite first and second ends, a first longitudinal segment including said first end, a second longitudinal segment including said second end and being coaxially aligned with said first longitudinal segment; and an internal passage extending longitudinally within the waveguide along at least a portion of the waveguide from said first end through the first segment and into said second segment, the waveguide further having an inlet at said first end in fluid communication with said internal passage for taking liquid from the reservoir into the waveguide, and an outlet in said second segment in fluid communication with the internal passage for exhausting liquid from the pump; the first longitudinal segment being sized larger than the second longitudinal segment in at least one of a length, a thickness and an outer cross-sectional dimension of the waveguide; and an excitation device operable to ultrasonically excite said waveguide to vibrate at least longitudinally of the waveguide.

10. The ultrasonically driven pump of claim 9 wherein the internal passage extends longitudinally the entire length of the waveguide from said first end to said second end, the outlet being disposed at said second end.

11. The ultrasonically driven pump of claim 9 wherein the internal passage has a cross-sectional dimension, said cross-sectional dimension of the internal passage being substantially constant along the entire length of the internal passage.

12. The ultrasonically driven pump of claim 9 wherein the excitation device and the waveguide together define an ultrasonic waveguide assembly, said assembly having a length of about one-half wavelength.

13. The ultrasonically driven pump of claim 10 wherein the excitation device is connected to the waveguide in a stacked configuration, said excitation device having an internal passage in fluid communication with the waveguide outlet for receiving liquid exhausted from the waveguide.

14. The ultrasonically driven pump of claim 9 further comprising a mounting member connected to the waveguide, said mounting member being configured for interconnecting the waveguide with the reservoir housing and to substantially vibrationally isolate the housing from the waveguide.

15. The ultrasonically driven pump of claim 14 wherein the mounting member is connected to the waveguide generally at the nodal region of the waveguide.

16. A method of pumping a liquid, the method comprising:

immersing at least a portion of an elongate ultrasonic waveguide in a reservoir of liquid, said waveguide having longitudinally opposite first and second ends, a nodal region located longitudinally between said first and second ends of the waveguide, and an internal passage extending longitudinally within the waveguide along at least a portion of the waveguide from said first end to beyond the nodal region toward said second end of the waveguide, the waveguide having an inlet at said first end in fluid communication with said internal passage and an outlet in fluid communication with the internal passage and spaced longitudinally from the inlet at a location longitudinally beyond the nodal region of the waveguide relative to said inlet, the immersed portion of the waveguide extending from the inlet at the first end of the waveguide to a location that is one of generally longitudinally adjacent, at and beyond the nodal region of the waveguide; and ultrasonically exciting the waveguide to cause the waveguide to vibrate at an ultrasonic frequency.

17. The method set forth in claim 16 wherein the waveguide is configured for greater longitudinal displacement at said inlet than at said outlet of the waveguide in response to being ultrasonically excited.

18. The method set forth in claim 16 wherein the reservoir has a housing containing liquid to be pumped, the method further comprising mounting the waveguide on the reservoir housing with the housing being vibrationally isolated from the waveguide.

19. The method set forth in claim 18 wherein the mounting step further comprises mounting the waveguide on the housing at a longitudinal location of the waveguide that is one of adjacent to the nodal region of the waveguide, at the nodal region of the waveguide, and nearer to the second end of the waveguide than to the first end thereof.

20. The method set forth in claim 16 wherein the step of ultrasonically exciting the waveguide comprises exciting the waveguide at a frequency in the range of about 20 kHz to about 40 kHz.

* * * * *